US008118084B2

(12) United States Patent
Harvey

(10) Patent No.: US 8,118,084 B2
(45) Date of Patent: Feb. 21, 2012

(54) HEAT EXCHANGER AND METHOD FOR USE IN PRECISION COOLING SYSTEMS

(75) Inventor: Thomas E. Harvey, Columbus, OH (US)

(73) Assignee: Liebert Corporation, Columbus, OH (US)

( * ) Notice: Subject to any disclaimer, the term of this patent is extended or adjusted under 35 U.S.C. 154(b) by 1138 days.

(21) Appl. No.: 11/742,787

(22) Filed: May 1, 2007

(65) Prior Publication Data

US 2008/0271878 A1 Nov. 6, 2008

(51) Int. Cl.
*F28F 7/00* (2006.01)

(52) U.S. Cl. ..... 165/139; 165/146; 165/153

(58) Field of Classification Search ..... 165/139, 165/146, 153

See application file for complete search history.

(56) References Cited

U.S. PATENT DOCUMENTS

| | | | | |
|---|---|---|---|---|
| 3,217,796 | A * | 11/1965 | Eklund et al. | 165/101 |
| 5,482,112 | A * | 1/1996 | Sasaki et al. | 165/146 |
| 5,875,838 | A * | 3/1999 | Haselden | 165/146 |
| 6,155,075 | A | 12/2000 | Hanson et al. | |
| 6,273,184 | B1 * | 8/2001 | Nishishita | 165/140 |
| 6,341,648 | B1 | 1/2002 | Fukuoka et al. | |
| 6,389,696 | B1 * | 5/2002 | Heil et al. | 165/139 |
| 6,389,825 | B1 * | 5/2002 | Wightman | 165/139 |
| 6,752,202 | B2 * | 6/2004 | Holm et al. | 165/167 |
| 2004/0079516 | A1 | 4/2004 | Leeson et al. | |
| 2005/0051317 | A1 | 3/2005 | Chin et al. | |
| 2005/0120737 | A1 | 6/2005 | Borror | |
| 2005/0132744 | A1 | 6/2005 | Rohrer et al. | |
| 2005/0207116 | A1 | 9/2005 | Yatskov | |
| 2005/0247440 | A1 * | 11/2005 | Meissner et al. | 165/148 |
| 2006/0070399 | A1 | 4/2006 | Bae et al. | |
| 2006/0102322 | A1 | 5/2006 | Madara | |
| 2006/0180301 | A1 | 8/2006 | Baer | |
| 2006/0191677 | A1 | 8/2006 | Viczena | |
| 2006/0242985 | A1 * | 11/2006 | Leck et al. | 62/323.1 |

FOREIGN PATENT DOCUMENTS

| | | |
|---|---|---|
| CN | 1590925 | 3/2005 |
| DE | 10223712 | 10/2003 |
| DE | 10328458 | 1/2005 |
| EP | 1524888 | 4/2005 |
| FR | 2815401 | 4/2002 |
| JP | 62112999 | 5/1987 |
| JP | 06257892 | 9/1994 |
| JP | 2004286246 | 10/2004 |
| WO | 9811395 | 3/1998 |
| WO | 03046457 | 6/2003 |
| WO | 2005071329 | 8/2005 |

OTHER PUBLICATIONS

International Search Report for Corresponding International Patent Application No. PCT/US2007/088014.
Written Opinion for Corresponding International Patent Application No. PCT/US2007/088014.

* cited by examiner

*Primary Examiner* — Teresa Walberg
(74) *Attorney, Agent, or Firm* — Locke Lord LLP

(57) ABSTRACT

An improved precision cooling system for high heat density applications comprises a heat exchanger having more fluid outlet conduits than fluid inlet conduits to optimize the pressure drop across the heat exchanger at a given fluid flow rate. The heat exchanger may be of microchannel or tube fin construction, and the cooling system may utilize single phase or multi-phase pumped or compressed fluids.

23 Claims, 5 Drawing Sheets

HEAT EXCHANGER AND METHOD FOR USE IN PRECISION COOLING SYSTEMS

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The inventions disclosed and taught herein relate generally to a precision cooling systems for heat generating objects; and more specifically to an improved heat exchanger for use in precision cooling systems for high density heat load environments.

2. Description of the Related Art

Many new computer and electronic system designs combine multiple heat-producing components, such as microprocessors or processor boards, in an enclosed environment. Supercomputers and other large computer systems typically include a large number of processors housed in cabinets or racks. Due to the demand for more components in increasingly smaller spaces, computer and electronic systems are increasingly configured and designed to be closer together, and many existing cooling systems for these electronic systems may not provide adequate heat removal.

At the same time, newer, more powerful electronic components are constantly being introduced. With this higher performance, these new components typically have significantly increased heat generation. Thus, these new components are driving up the heat production of new computer and electronic designs to the point where traditional heat cooling methods may not provide enough cooling capacity to these new systems to operate at their designed conditions in close-packed, enclosed spaces, such as rack enclosures. As a result, these newer, more powerful, high heat-producing systems may have to operate at reduced performance levels to limit the heat generation. Further, some locations in a computer cabinet, rack or other electronic system may be hotter than others during operation of the system because there may be a density of components and/or poor positioning with respect to the flow of cooling air.

Typical cooling systems for electronic and computer systems, such as rack enclosures, include simply drawing ambient air over the electronic components to cool them. In this cooling solution, many of the components receive warmer air than other components because the air has already passed over and absorbed heat from other components. Consequently, some components may not be adequately cooled. Also, these types of systems usually dumped the removed heat load into the general environment, such as a computer room, which may overload the environmental cooling system.

Other cooling systems have used heat exchangers to transfer heat from the air to a fluid, for example, water or refrigerant, contained in the heat exchanger. In these systems air is passed over the heat exchanger and heat is transferred to the fluid in the heat exchanger and then removed from the system. Systems may differ as to whether the air entering the enclosure or system is cooled prior to flowing across the heat-producing components, or whether the air exiting the enclosure or system is cooled after having removed heat from the components, or both.

Air-to-fluid heat exchanger systems may utilize a single phase fluid, such as chilled water, or a multi-phase fluid, such as a conventional two-phase refrigerant. Multi-phase fluid systems may include a conventional vapor compression system in which a gas is compressed to allow heat rejection at higher outdoor temperatures, or a pumped system in which heat is rejected to a lower temperature. In both systems, the temperature and pressure of the fluid are controlled so that the heat to be removed causes the fluid to boil, thereby absorbing heat. In this regard, the disclosure and teaching of co-pending application Ser. No. 10/904,889, entitled Cooling System for High Density Heat Load, which was published on Jun. 9, 2005, as Publication No. 2005/0120737; and co-pending application Ser. No. 11/164,187, entitled Integrated Heat Exchangers in a Rack For Vertical Board Style Computer Systems, which was published on May 18, 2006, as Publication No. 2006/0102322, are incorporated by reference herein for all purposes.

To effectively cool the ever increasing heat densities with conventional systems, typical solutions to increase the heat transfer rate include increasing the flow of refrigerant through the cooling system and/or increasing the flow of air across the heat exchanger. However, in pumped and vapor compression refrigerant systems, the temperature at which the fluid begins to boil is determined by, among other things, the pressure drop across heat exchanger. As the pressure drop across the heat exchanger increases, the temperature at which the refrigerant in the heat exchanger boils also increases. A higher refrigerant evaporation temperature in the heat exchanger may lead to a decrease in the overall cooling capacity of heat exchanger because the temperature difference between the heated air and refrigerant evaporation temperature decreases, and the system is not able to remove as much heat from the air. In addition, increased flow rate of fluid through a heat exchanger tends to increase the pressure drop across the heat exchanger.

The inventions disclosed and taught herein are directed to precision cooling systems for high density heat loads including an improved heat exchanger for use in precision cooling systems for high density heat load environments.

BRIEF SUMMARY OF THE INVENTION

A cooling system for high density heat loads is provided comprising an air-to-fluid heat exchanger having a fluid inlet conduit of a predetermined size; and a plurality of fluid outlet conduits coupled to the heat exchanger having a combined flow area greater than the flow area of the inlet conduit.

Additionally, a cooling system for a high density heat load is provided comprising an air-to-fluid heat exchanger having a fluid inlet conduit of a predetermined size and a plurality of fluid outlet conduits having a combined flow area greater than the flow area of the inlet conduit and having a predetermined pressure drop at a predetermined fluid flow rate; a second heat exchanger adapted to remove heat from the fluid; a pump coupled to the heat exchangers and adapted to circulate a two-phase refrigerant through the heat exchangers at least a predetermined flow rate.

Still further, a method of retrofitting an existing cooling system for a higher density heat load is disclosed, which comprises determining an increased fluid flow rate through an existing heat exchanger to create a desired cooling capacity; determining a number of additional heat exchanger fluid outlet and/or inlet conduits to establish a preferred pressure drop across the heat exchanger at the predetermined flow rate; providing a heat exchanger having the determined number of fluid outlet and/or inlet conduits; and installing the heat exchanger in the system.

Other and further aspects of the inventions disclosed herein will become apparent upon reading the detailed description in concert the following figures.

DETAILED DESCRIPTION

Figure 1:
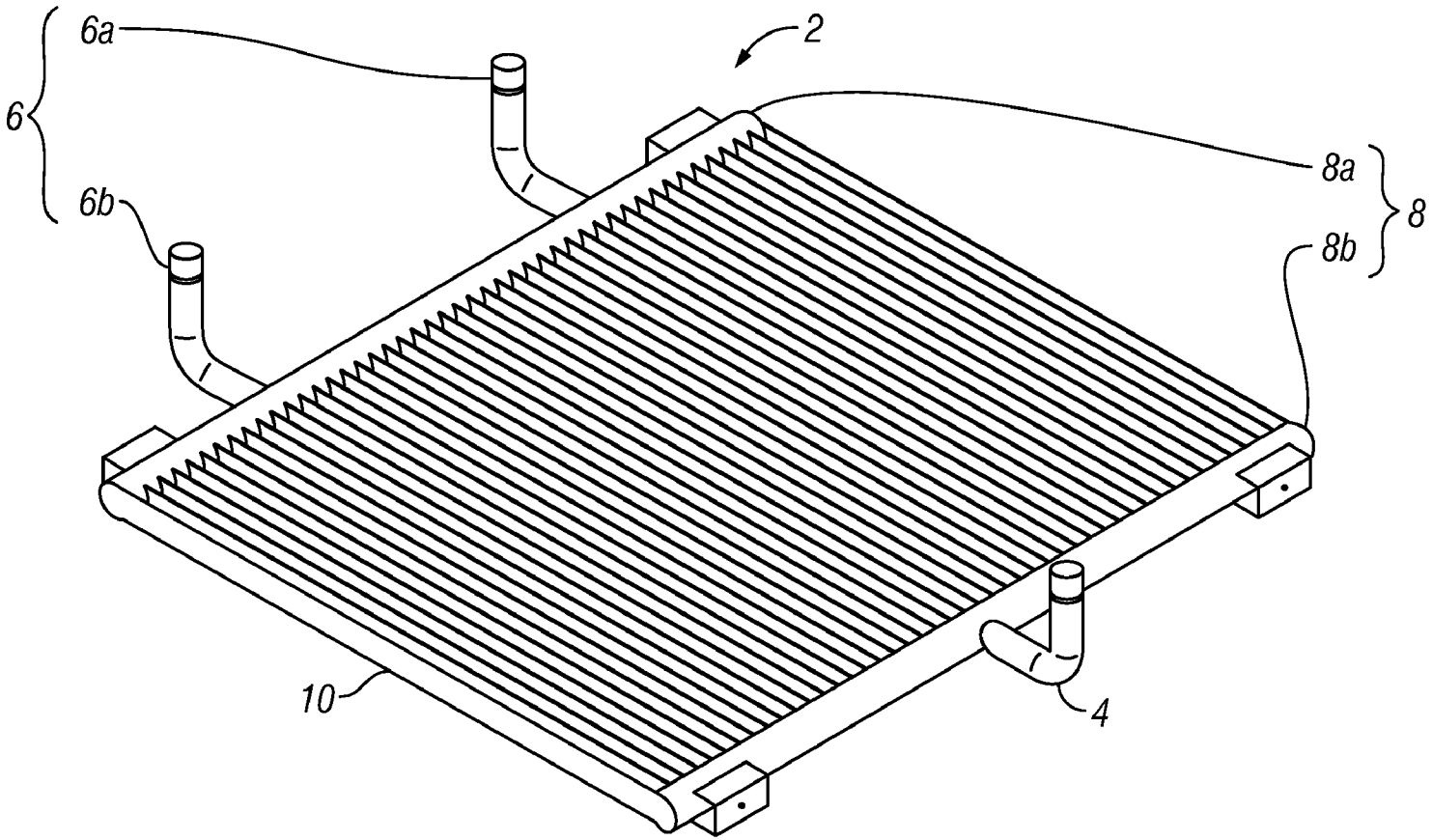
FIG. 1 illustrates an exemplary embodiment of a heat exchanger utilizing aspects of the present invention.

The Figures described herein and the written description of specific structures and functions below are not presented to limit the scope of the invention disclosed and taught herein or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

An improved cooling system and improved heat exchanger for precision cooling of high-density heat loads is hereby disclosed and taught to those of skill in the art. The heat exchanger, such as an air-to-fluid evaporator, may be of fin and tube construction or microchannel construction, or similar construction and material that allow transfer of heat from air or another gas flowing across the heat exchanger to a fluid in the heat exchanger. It will be appreciated that for cooling systems in which the overall size of the heat exchanger, for example evaporator, is fixed or limited by, for example, enclosure size, increasing the cooling capacity of the system may require increasing the fluid flow rate through the heat exchanger. The present invention permits the pressure drop across the heat exchanger to be optimized to increase the heat transfer properties of the cooling system for a given heat density and fluid flow rate.

A cooling system as taught herein may include a heat exchanger having a predetermined number of fluid inlets, $N_{inlet}$, such as 1, and a predetermined number of fluid outlets, $N_{outlet}$, where $N_{outlet}$, is greater than $N_{inlet}$, such that the outlet flow area is greater than the inlet flow area to thereby control the pressure drop across the heat exchanger. For example, and without limitation, a microchannel heat exchanger for a pumped, two-phase refrigerant cooling system utilizing aspects of the inventions disclosed and taught herein may have 1 fluid inlet and 2 fluid outlets to reduce the pressure drop across the heat exchanger for a give fluid flow rate there through.

Turning now to the Figures, which illustrate exemplary embodiments only, FIG. 1 illustrates a microchannel heat exchanger 2 having one fluid supply or inlet conduit 4, and an inlet manifold 8*b*. The heat exchanger 2 also has an outlet manifold 8*a* and two return or outlet conduits, 6*a* and 6*b* (collectively "6"). Interposed between the inlet manifold 8*b* and outlet manifold 8*a*, are a plurality of flow conduits 10. As is known, the flow conduits 10 are typically arranged so the fluid entering the inlet manifold 8*b* flows through the plurality of conduits 10 in substantially simultaneous, or parallel, fashion. While the conduits 10 themselves function to transfer heat from the air flowing across them, additional heat transfer structures, such as fins, may be interposed between or coupled to the conduits 10. The preferred embodiment of the heat exchanger illustrated in FIG. 1 is an aluminum microchannel air-to-fluid heat exchanger.

The inlet manifold 8*b* is connected to the supply conduit 4 to allow a fluid, for example refrigerant, to flow from the supply conduit 4 to the manifold 8*b*. The manifold 8*b* is connected to flow conduits 10 to allow the liquid coolant to flow from the manifold. In this exemplary embodiment, the flow conduits 10 are composed of aluminum microchannel tubing. Each flow conduit 10 contains a plurality of flow channels (not shown), or microchannels, that run the length of the flow conduits 10. The fluid flows through the microchannels from inlet manifold 8*b* to the outlet manifold 8*a*.

In use, heated air is passed across the heat exchanger 2, generally, and flow conduits 10, specifically, from the bottom to the top of FIG. 1 (or vice versa), and heat is transferred from the air to the moving fluid in the heat exchanger 2. As the fluid absorbs heat it boils, thereby absorbing heat from the air.

Outlet manifold 8*a* is connected to output conduits 6*a* and 6*b* (collectively "6"). The fluid, which is now a mixture of gas and liquid phases, enters manifold 8*a* and flows to the outputs conduits 6 and out of the heat exchanger 2. Once the heated fluid leaves the heat exchanger 2, the heat may be removed from the fluid by well know means, such as a fluid-to-fluid heat exchanger or another air-to-fluid heat exchanger.

To increase the cooling capacity of a heat exchanger 2 of fixed or limited size, return conduits 6 can added or removed to increase the efficiency and cooling capacity of the heat exchanger 2. By adding and/or removing return conduits 6 to the heat exchanger 2, the outlet fluid flow area increases and the pressure drop across the heat exchanger 2 can be optimized to maximize the efficiency and cooling capacity of the heat exchanger 2. When a return conduit 6 is added to the heat exchanger 2, the liquid coolant has an increased outlet flow area to flow through. As a result, the pressure drop across the heat exchanger 2 decreases, the fluid evaporation temperature drops, and the heat exchanger 2 is able to remove more heat from the air that is flowing over the heat exchanger. By removing more heat from the air, the heat exchanger 2 is more efficient and/or has an increased cooling capacity.

For example, assume that the optimum pressure drop across the flow conduits of a microchannel evaporator is three pounds per square inch ("psi"), but the heat exchanger exhibits a 6 psi pressure drop at the necessary fluid flow rate. This means that the heat exchanger is not providing the most cooling capacity at the higher flow rate because the evaporation temperature of the fluid has been increased by the larger pressure drop. The present invention teaches that adding one or more additional return conduits 6 to outlet manifold 8*a* may decrease the pressure drop across the heat exchanger thereby lowering the fluid evaporation temperature and increasing the cooling capacity of the cooling system.

Figure 2:
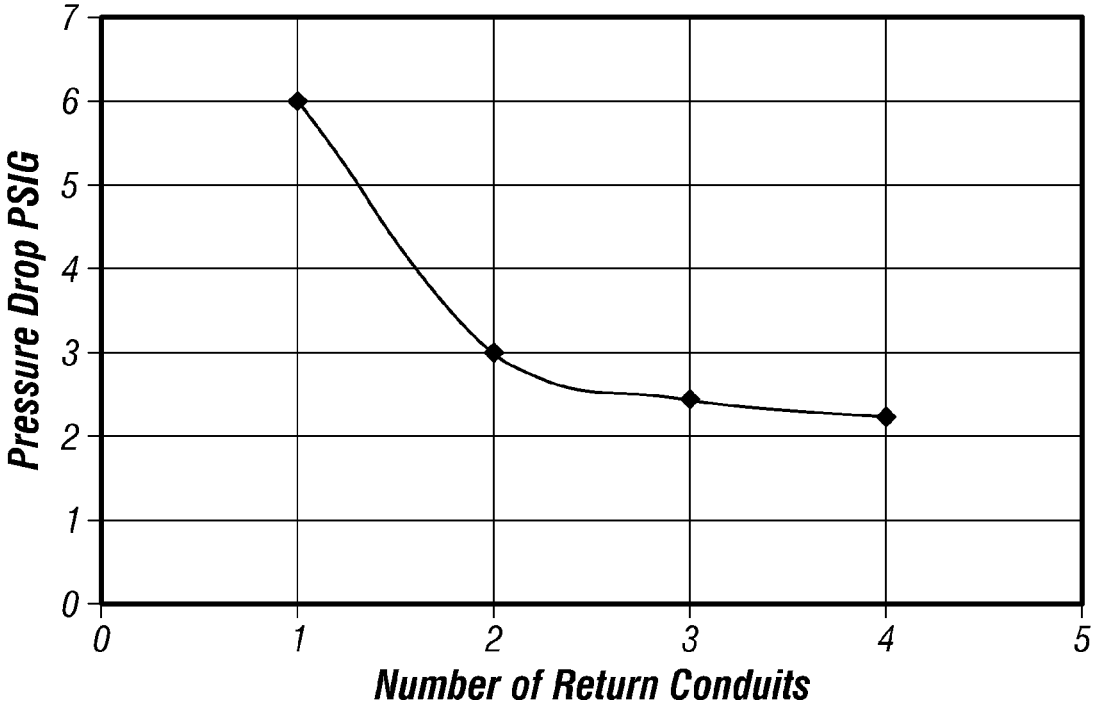
FIG. 2 is a graph that illustrates the relationship between the number of outlet conduits to the pressure drop across a heat exchanger for given flow rates.

FIG. 2 is a graph that illustrates an approximate relationship between the outlet flow area and pressure drop for a typical microchannel heat exchanger used in precision cooling systems for high density heat loads, such as computer or electronics enclosures. The approximate relationship illustrated in FIG. 2 is based on a microchannel heat exchanger having flow conduits or tubes with an height of about 0.71 inches (18 mm) which were coupled to manifolds having an outside diameter of about 0.87 inches (22 mm). The inlet conduit and outlet conduit(s) of the microchannel heat exchanger have an inside diameter of about 0.5 inches. FIG. 2 illustrates how increasing the number of outlet conduits allows higher fluid flow rates through the heat exchanger at a given pressure drop.

It will be appreciated that additional control of the pressure drop across a heat exchanger may be obtained by increasing and/or decreasing the number of inlet conduits as well. The present invention contemplates optimizing the cooling capacity of one or more heat exchangers by optimizing the pressure drop across the heat exchanger through manipulation of the flow areas of both the inlet and outlet conduits.

Further, it should be appreciated that additional supply conduits 4 and output conduits 6 create additional benefits beyond increased cooling capacity. Additional supply conduits 4 and output conduits 6 may be used to create a more even or controlled distribution of fluid across the flow conduits 10. Heat exchangers 2 with only one supply conduit 4 and one outlet conduit 6 may supply the flow conduits 10 closest to them with more coolant than the flow conduits 10 further away. For example, in FIG. 1, the supply conduit 4 may supply more fluid to the inner flow conduits 10 than the outer flow conduits 10. If two supply conduits 4 were added to the heat exchanger 2, then the liquid coolant would be better distributed to the outer flow conduits 10. Further, the additional supply conduits 4 or return conduits 6 may be placed closer to warmer areas of the electronic device to be cooled. This would create increased liquid coolant flow over the warmer area thus cooling the air in than area more efficiently than a less warm area of the electronic device to be cooled.

In another embodiment of the present invention, instead of adding or removing return conduits 6 or supply conduit 4, the size of the return conduits 6 or supply conduits 4 can be increased or decreased to create the optimum pressure drop across the flow conduits 10 and thus increase the cooling capacity. Additionally, baffles may be added to the manifolds 8 of the heat exchanger 2 to route the liquid coolant in a desired path to provide (1) a more even distribution of liquid coolant over the surface of the heat exchanger 2 and/or (2) an uneven distribution of liquid coolant to cool uneven electronic systems.

Figure 3:
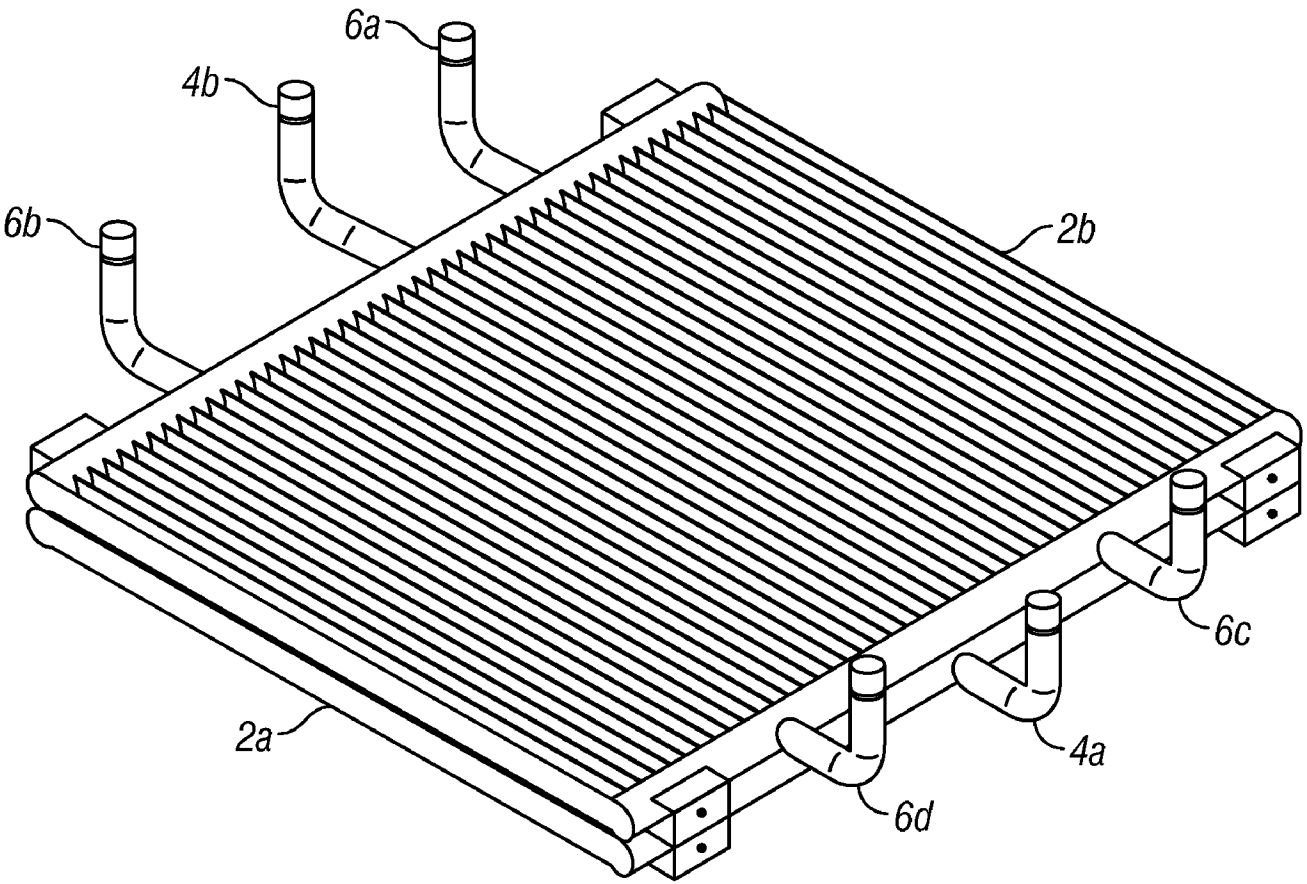
FIG. 3 illustrates an alternative embodiment of a heat exchanger system utilizing aspects of the present invention.

FIG. 3 illustrates an alternative embodiment of a heat exchanger. In this embodiment, two or more heat exchangers 2*a* and 2*b*, (collectively "2") are generally stacked so that their flow conduits are generally parallel and the fluid of the heat exchangers 2 flow generally in opposite directions. The liquid coolant in heat exchanger 2*a* flows from supply conduit 4*a* through the heat exchanger 2*a* and out of the return conduits 6*a* and 6*b*. The liquid coolant in the heat exchanger 2*b* flows from supply conduit 4*b* to return conduits 6*c* and 6*d*. The air generally flows across the heat exchangers 2 from the bottom to the top of FIG. 2 (or vice versa). This alternative embodiment has several advantages. It has a higher cooling capacity, redundancy, and better fluid distribution. First, because this embodiment can have two or more heat exchangers 2 arranged in a sandwiched fashion, the warm air flows across two or more heat exchangers and therefore may remove more heat from the air. Second, this embodiment offers redundancy in case one or more heat exchangers 2 fail or stop receiving liquid coolant. If one of the heat exchangers 2 stops cooling the air, the second heat exchanger 2 will be able to continue cooling the load until the first heat exchanger is repaired. Third, this embodiment offers better distribution because coolant in the two heat exchangers flow in different directions and thus have their own cooler and warmer areas. By sandwiching two heat exchangers 2 together this eliminates the areas of less cooling. Further embodiments of FIG. 2 could include two or more heat exchangers 2 that have the liquid coolant flowing generally in the same direction.

Figure 4:
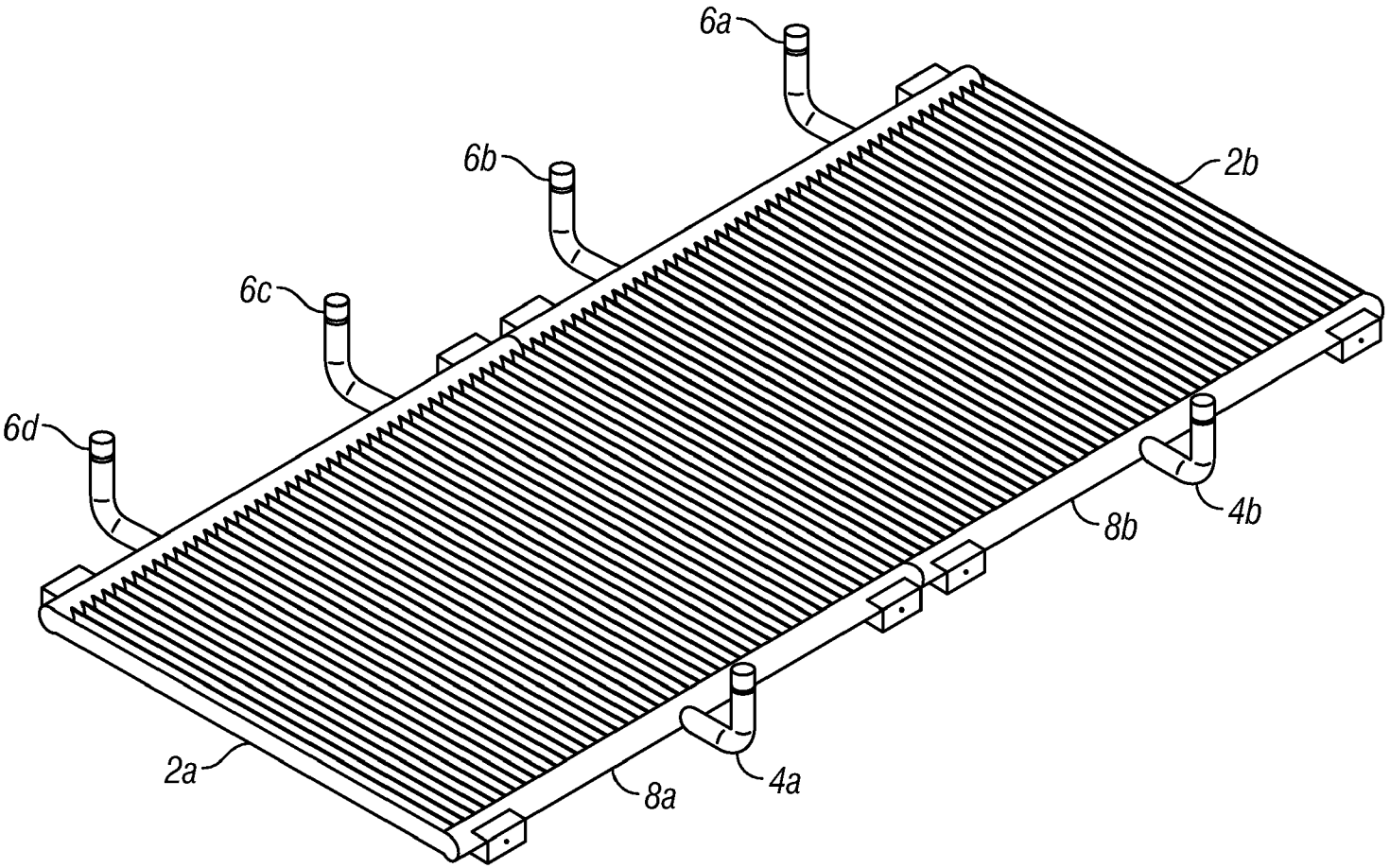
FIG. 4 illustrates an alternative embodiment of a heat exchanger system utilizing aspects of the present invention.

FIG. 4 illustrates an another embodiment of a heat exchanger according to the present invention. In this embodiment two or more heat exchangers 2*a* and 2*b* (collectively "2") are placed adjacent to one other so that their flow conduits are generally in the same plane. Further embodiments of FIG. 2 could include more two or more heat exchangers 2 that have the liquid coolant flowing in generally the same direction. This alternative embodiment has several advantages. It has both a higher cooling capacity, better distribution, and redundancy. First, this embodiment creates a heat exchanger with a greater surface area which increases the heat exchangers 2 cooling capacity. Second, this embodiment offers redundancy in case one or more heat exchangers 2 fail or stop receiving liquid coolant. If one of the heat exchanger 2 stops cooling the air, the second heat exchanger 2 will be able to continue cooling the electronic equipment. If one large heat exchanger had been used instead of two separate heat exchangers all of the electronic components would be without cooling. But in this embodiment only half of the electronic components would be without cooling. Third, this embodiment offers better distribution because the heat exchangers will have more supply conduits, 4*a* and 4*b*, and return conduits 6*a*-6*d* than a single heat exchanger 2. It will be appreciated that the stacked heat exchanger of FIG. 3 may be combined with the linear heat exchanger of FIG. 4 to customize the heat removal for an asymmetrical high density heat load.

Figure 5:
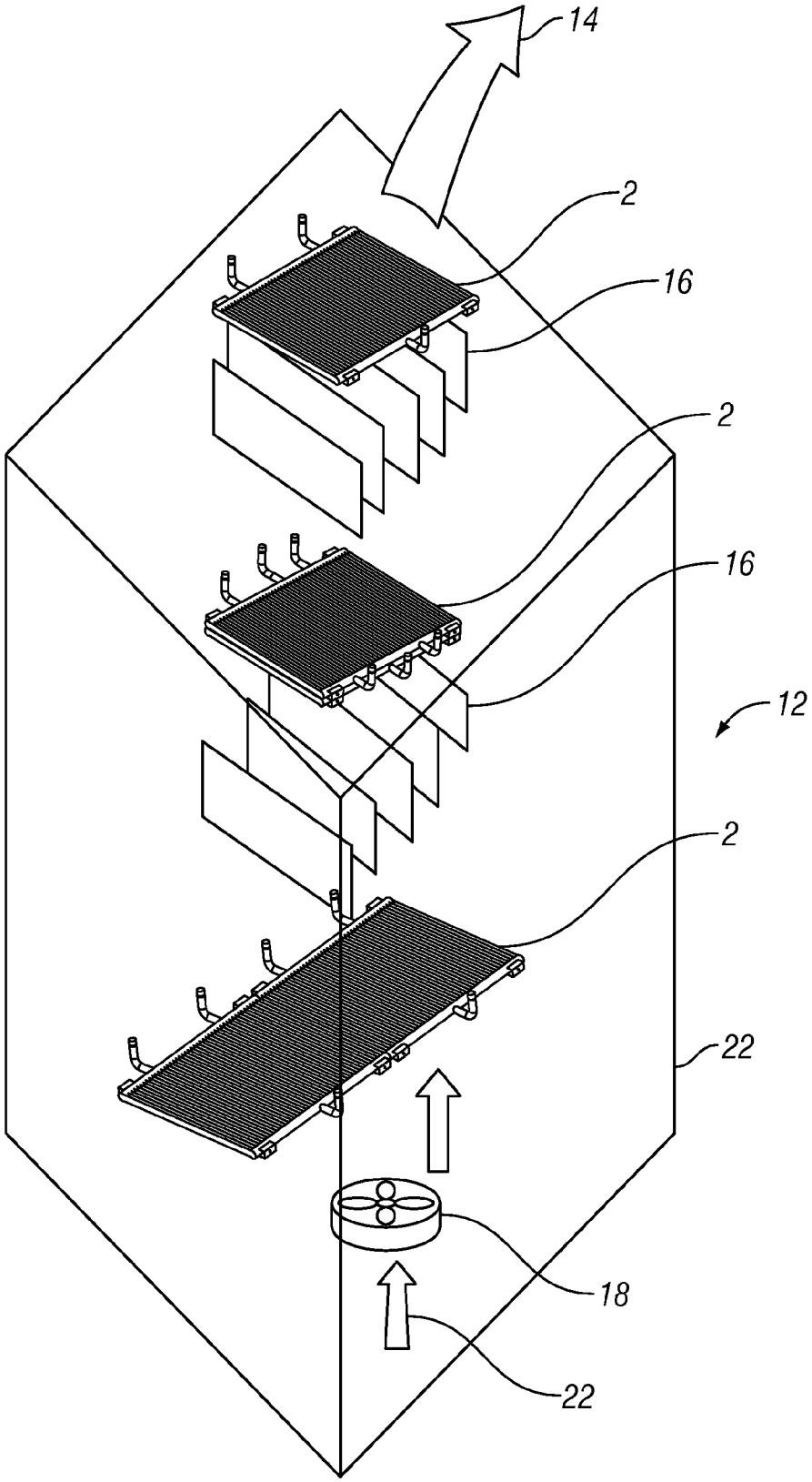
FIG. 5 illustrates multiple embodiments of heat exchangers in a high density heat load environment.

FIG. 5 illustrates multiple embodiments of heat exchangers in a cooling system 12. The cooling system 12 generally includes an enclosure 22 comprising an inlet air opening 20, a air mover, such as fan 18, a plurality of heat exchangers 2, a plurality of heat generating objects 16, and an outlet air opening 14. The cooling system 12 may include a plurality of heat exchangers 2 as are described and claimed herein. The heat generating objects can include any type of electronic components, for example microprocessors. The cooling system 12 is configured so that the heat generating objects are cooled using the plurality of heat exchangers. For example, air is pull into the system by fan 18 through inlet air opening 20. The air is cooled by the plurality of heat exchanger 2. The cooled air is then blown across the heat generating objects 16. This process is repeated until the air exits the cooling system through the outlet air opening 14. As discussed previously, the air may be returned to the environment in substantially the same condition (e.g., temperature and relative humidity) as it enters the enclosure 22. Alternately, the returned air 14 may add heat to the environment or return chilled air to the environment.

A method is also disclosed for configuring the heat exchangers in a cooling system to maximize the cooling capacity of the system, by, for example, minimizing the pressure drop across the flow conduits. For example, it will now be appreciated that the present inventions have distinct application in retrofitting existing enclosure cooling systems to have additional cooling capacity. An existing cooling system may be optimized by determining the cooling capacity needed for the additional heat load; determining a desired fluid flow rate through the cooling system or at least through one or more heat exchangers; determining the appropriate number of additional inlet and/or outlet conduits for the one more heat exchangers; installing the determined additional inlet and/or outlet conduits to the existing or new heat exchangers.

Other and further embodiments utilizing one or more aspects of the inventions described above can be devised without departing from the spirit of Applicant's invention. Further, the various methods and embodiments of the heat exchanger can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicants intend to fully protect all such modifications and improvements that come within the scope or range of equivalent of the following claims.

What is claimed is:

1. A cooling system for high density heat loads having an air-to-fluid heat exchanger, the heat exchanger comprising:

an inlet manifold having a fluid inlet conduit with a predetermined cross-sectional flow area;

an outlet manifold;

a first plurality of heat transfer conduits fluidicly coupled between the inlet manifold and the outlet manifold; and a plurality of fluid outlet conduits coupled to the outlet manifold and having a combined cross-sectional flow area greater than the cross-sectional flow area of the inlet conduit, thereby minimizing pressure drop across the heat exchanger;

wherein the combined cross-sectional flow area of the plurality of fluid outlet conduits is either maintained or increased over a distance sufficient to permit the minimizing of the pressure drop across the heat exchanger.

2. The system of claim 1, wherein at least one of the heat transfer conduits is a microchannel heat transfer conduit in flow communication with the inlet and outlet conduits.

3. The system of claim 2, wherein the heat exchanger is an aluminum microchannel air-to-refrigerant heat exchanger.

4. The system of claim 1, wherein the fluid is a two phase refrigerant.

5. The system of claim 4, wherein the system is a pumped refrigerant system.

6. The system of claim 4, wherein the system is a vapor compression system.

7. The system of claim 1, wherein the inlet manifold comprises one or more internal baffles to direct the flow of fluid.

8. The system of claim 1, further comprising:

a second air-to-fluid heat exchanger having a second fluid inlet conduit with a predetermined cross-sectional flow area;

a second plurality of fluid outlet conduits having a combined cross-sectional flow area greater than the cross-sectional flow area of the second inlet conduit; and a second plurality of heat transfer conduits fluidicly coupled between the second fluid inlet conduit and the second plurality of fluid outlet conduits;

wherein the first and second heat exchangers are coupled together so that the first and second pluralities of heat transfer conduits are adjacent one another; and wherein the first and second heat exchangers operate independently, thereby being redundant.

9. The system of claim 8, wherein the first and second heat exchangers are stacked adjacent one another in a direction of air flow through the heat exchangers.

10. The system of claim 9, wherein the fluid flowing through the first heat exchanger flows in a direction different from the fluid flow direction of the second heat exchanger.

11. The system of claim 10, wherein the fluid flow directions are substantially opposite one another.

12. The system of claim 8, wherein the first and second heat exchangers are located adjacent one another in a common plane.

13. A cooling system for a high density heat load, comprising:

an air-to-fluid heat exchanger as claimed in claim 1 and having a predetermined pressure drop at a predetermined fluid flow rate;

a second heat exchanger adapted to remove heat from the fluid; and a pump coupled to the heat exchangers and adapted to circulate a two-phase refrigerant through the heat exchangers at least a predetermined flow rate.

14. The system of claim 1, wherein at least one of the plurality of fluid outlet conduits is configured to increase an overall cooling capacity of the system.

15. The system of claim 1, further comprising at least one additional fluid inlet conduit configured to increase an overall cooling capacity of the system.

16. The system of claim 1, further comprising:

a second fluid inlet conduit coupled to the inlet manifold, the fluid inlet conduits having a combined cross-sectional flow area; and wherein the plurality of fluid outlet conduits includes at least three outlet conduits, the combined cross-sectional flow area of the outlet conduits being greater than the combined cross-sectional flow area of the inlet conduits.

17. A method of retrofitting an existing cooling system for a higher density heat load, comprising:

determining an increased fluid flow rate through an existing heat exchanger to create a desired cooling capacity;

determining a number of additional heat exchanger fluid outlet and/or inlet conduits to establish a preferred pressure drop across the existing heat exchanger at the predetermined flow rate;

providing a new heat exchanger as claimed in claim 1 and having the determined number of fluid outlet and/or inlet conduits; and installing the new heat exchanger in the system in place of the existing heat exchanger.

18. The method of claim 17, wherein the new heat exchanger comprises a plurality of microchannel heat transfer conduits in flow communication with the inlet and outlet conduits.

19. The method of claim 18, wherein the new heat exchanger is an aluminum microchannel air-to-refrigerant heat exchanger.

20. The method of claim 17, wherein the fluid is a two phase refrigerant.

21. The method of claim 20, wherein the system is a pumped refrigerant system.

22. The method of claim 17, wherein providing a new heat exchanger comprises modifying the existing heat exchanger in the cooling system.

23. The method of claim 17, wherein providing a new heat exchanger comprises replacing the existing heat exchanger in the cooling system.

* * * * *